US009476424B2

(12) United States Patent
Richter et al.

(10) Patent No.: US 9,476,424 B2
(45) Date of Patent: Oct. 25, 2016

(54) APPLIANCE PUMP WITH ANGLED FLOW PATH AND AXIAL FLOW IMPELLER

(71) Applicant: Nidec Motor Corporation, St. Louis, MO (US)

(72) Inventors: Jason A. Richter, Glen Carbon, IL (US); William D. Moore, Florissant, MO (US); Joshua M. Biro, Wood River, IL (US)

(73) Assignee: Nidec Motor Corporation, St. Louis, MO (US)

( * ) Notice: Subject to any disclaimer, the term of this patent is extended or adjusted under 35 U.S.C. 154(b) by 469 days.

(21) Appl. No.: 13/842,099

(22) Filed: Mar. 15, 2013

(65) Prior Publication Data

US 2014/0127060 A1 May 8, 2014

Related U.S. Application Data

(60) Provisional application No. 61/723,253, filed on Nov. 6, 2012.

(51) Int. Cl.

| | |
|---|---|
| ***F04D 3/00*** | (2006.01) |
| ***F04D 13/06*** | (2006.01) |
| ***F04D 29/60*** | (2006.01) |
| ***F04D 29/40*** | (2006.01) |
| ***F04D 25/06*** | (2006.01) |
| ***F04D 29/52*** | (2006.01) |

(52) U.S. Cl.

CPC ..... *F04D 3/005* (2013.01); *F04D 3/00* (2013.01); *F04D 13/0606* (2013.01); *F04D 13/0653* (2013.01); *F04D 25/0606* (2013.01); *F04D 25/0686* (2013.01); *F04D 29/406* (2013.01); *F04D 29/528* (2013.01); *F04D 29/605* (2013.01)

(58) Field of Classification Search

CPC ..... F04D 3/00; F04D 3/005; F04D 13/06; F04D 13/0606; F04D 13/0666; F04D 13/08; F04D 25/0606; F04D 25/0653; F04D 25/0686; F04D 29/181; F04D 29/183; F04D 29/406; F04D 29/52; F04D 29/528; F04D 29/605; F04D 29/64; F04D 29/648; F04D 13/0653; F04D 13/086; F04D 29/548; F04D 29/56; F04D 29/566; F04D 29/007

See application file for complete search history.

(56) References Cited

U.S. PATENT DOCUMENTS

| | | | | | |
|---|---|---|---|---|---|
| 1,108,089 | A | * | 8/1914 | Van Ness | 415/112 |
| 1,430,141 | A | * | 9/1922 | Angus | 415/208.2 |
| 2,202,790 | A | * | 5/1940 | Forrest | 415/121.2 |
| 3,333,742 | A | * | 8/1967 | La Flame | 137/565.31 |
| 3,911,300 | A | * | 10/1975 | Lebkuchner | H02K 5/128 29/598 |

(Continued)

*Primary Examiner* — Charles Freay
*Assistant Examiner* — Timothy P Solak
(74) *Attorney, Agent, or Firm* — Hovey Williams LLP

(57) ABSTRACT

A household appliance includes a tub, in which a liquid is at least temporarily contained, and a pump assembly for effecting liquid flow within the tub. The pump assembly includes a housing including an integrally formed flow path portion defining an inlet, an outlet, and a flow path extending between and interconnecting the inlet and the outlet. The flow path portion defines a turn, such that part of the flow path extends in a direction oriented at an angle relative to the inlet axis. The pump assembly includes a rotatable impeller. The impeller includes a plurality of blades extending at least substantially radially from the impeller axis and configured to propel a fluid at least substantially axially thereby. The impeller is positioned in the flow path adjacent the inlet such that the impeller axis and the inlet axis are at least substantially parallel or at least substantially aligned.

22 Claims, 5 Drawing Sheets

(56) References Cited

U.S. PATENT DOCUMENTS 5,692,886 A * 12/1997 Kobayashi et al. ..... 417/423.12
7,905,122 B2 * 3/2011 Murray ..... D06F 35/007 68/12.02
2005/0100451 A1 * 5/2005 Manda et al. ..... 417/356
2005/0254974 A1 * 11/2005 Hoffmeier ..... F04D 15/0077 417/423.3
2010/0058528 A1 * 3/2010 Clarey ..... 4/492

* cited by examiner

APPLIANCE PUMP WITH ANGLED FLOW PATH AND AXIAL FLOW IMPELLER

CROSS-REFERENCE TO RELATED APPLICATIONS

This application claims the benefit of U.S. Provisional Application No. 61/723,253, filed Nov. 6, 2012, which is incorporated herein by reference in its entirety.

BACKGROUND OF THE INVENTION

1. Field of the Invention

The present invention relates generally to a household appliance and a pump for effecting liquid flow within a tub of the appliance. More particularly, the pump has an axial flow impeller and includes a turn in the flow path between the inlet and outlet.

2. Discussion of the Prior Art

Those of ordinary skill in the art will appreciate that pumps are often used in home appliances such as dishwashers and washing machines. Such appliances are typically designed to meet certain space requirements, with such space requirements often resulting in consequential size and shape limitations being placed on components thereof. For instance, size and shape limitations placed on pumps of such appliances may at least in part dictate both the type of pump to be used (e.g., a radial-flow centrifugal pump) and the size of the selected pump. Since performance characteristics often vary based on pump size and type, the performance of the appliance as a whole may thus be affected by the size and shape limitations placed on the components.

SUMMARY

According to one aspect of the present invention, a household appliance is provided. The appliance comprises a tub in which a liquid is at least temporarily contained and a pump assembly for effecting liquid flow within the tub. The pump assembly includes a housing, a motor, and an impeller. The housing includes a motor portion and a flow path portion. The flow path portion is integrally formed and defines an inlet, an outlet, and a flow path extending between and interconnecting the inlet and the outlet. At least one of the inlet and the outlet is fluidly coupled to the tub. The flow path extends along an inlet axis adjacent the inlet and along an outlet axis adjacent the outlet. The flow path portion defines a turn, such that at least part of the flow path extends in a direction that is oriented at an angle relative to the inlet axis. The motor includes a rotor and a stator, with the stator being fixed relative to the motor portion. The impeller is rotatable about an impeller axis. The impeller includes a plurality of blades extending at least substantially radially from the impeller axis and configured to propel a fluid at least substantially axially thereby. The impeller is positioned in the flow path adjacent the inlet such that the impeller axis and the inlet axis are at least substantially parallel or at least substantially aligned.

According to another aspect of the present invention, an appliance pump assembly for effecting liquid flow within a tub of the appliance is provided. The pump assembly comprises a housing, a motor, and an impeller. The housing includes a motor portion and a flow path portion. The flow path portion is integrally formed and defines an inlet, an outlet, and a flow path extending between and interconnecting the inlet and the outlet. At least one of the inlet and the outlet is configured for fluid connection to the tub. The flow path extends along an inlet axis adjacent the inlet and along an outlet axis adjacent the outlet. The flow path portion defines a turn, such that at least part of the flow path extends in a direction that is oriented at an angle relative to the inlet axis. The motor includes a rotor and a stator, with the stator being fixed relative to the motor portion. The impeller is rotatable about an impeller axis. The impeller includes a plurality of blades extending at least substantially radially from the impeller axis and configured to propel a fluid at least substantially axially thereby. The impeller is positioned in the flow path adjacent the inlet such that the impeller axis and the inlet axis are at least substantially parallel or at least substantially aligned.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

Preferred embodiments of the present invention are described in detail below with reference to the attached drawing figures, wherein.

Figure 1:
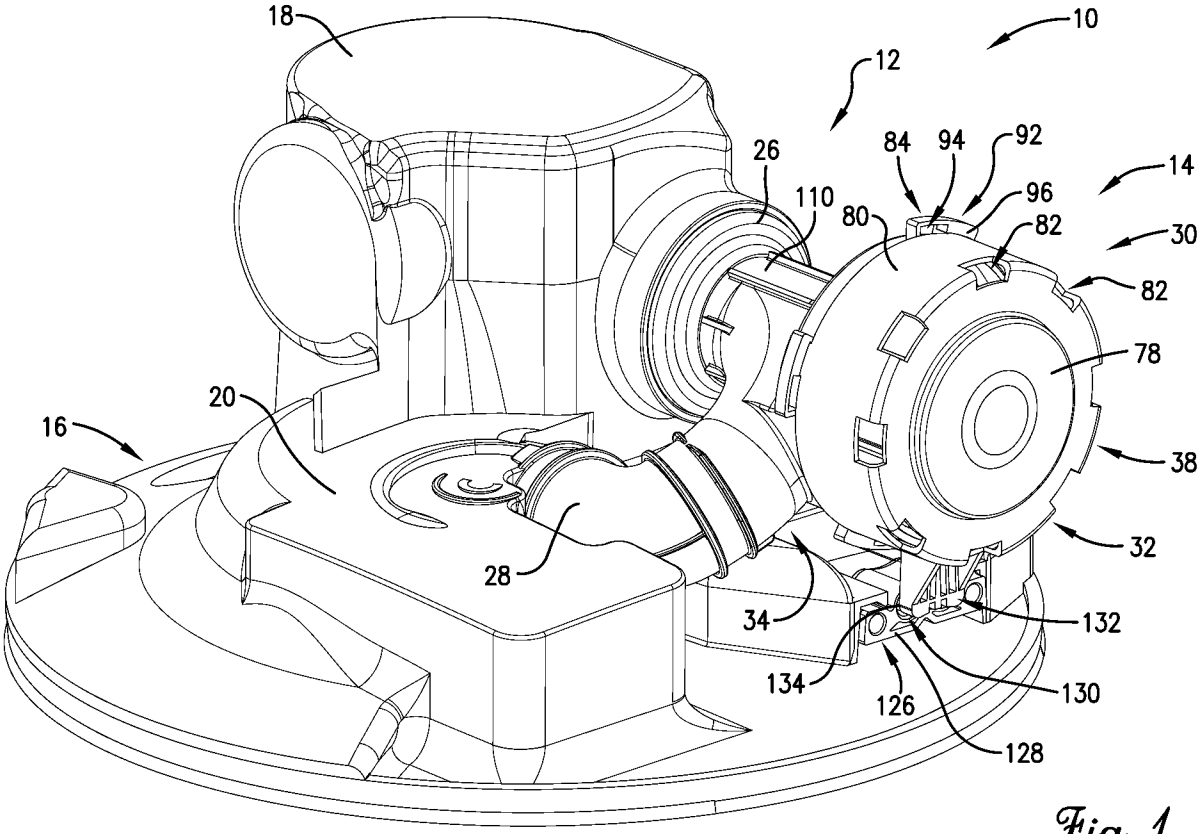
FIG. 1 is a bottom perspective view of a portion of a dishwasher constructed in accordance with the principles of a preferred embodiment of the present invention, particularly illustrating a sump and an associated pump.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

With initial reference to FIG. 1, a portion of a household appliance 10 is shown. In the illustrated embodiment, the appliance 10 is a dishwasher. However, it is permissible according to some aspects of the present invention for the appliance to be another type of household appliance, such as a washing machine.

As shown in FIG. 1, the appliance 10 preferably includes a tub 12 in which a fluid (or, more preferably, a liquid) is at least temporarily contained and a pump assembly 14 configured to effect fluid flow (or, more preferably, liquid flow) within the tub 12. In a preferred dishwasher embodiment, the tub 12 is preferably part of or positioned adjacent a dish chamber (not shown) containing or configured to contain dishes (not shown) to be washed. However, alternative tub arrangements and/or function are permissible.

Preferably, the tub 12 includes a sump 16 at its bottom end. Among other things, the sump 16 preferably includes a drainage basin 18 and a sprayer supply channel 20. In a preferred dishwasher embodiment, the drainage basin 18 preferably receives fluid from the dish chamber, while the sprayer supply channel 20 preferably supplies fluid to a plurality of sprayer arms (not shown) configured to direct the fluid onto the dishes in the dish chamber. However, it is permissible for the sump to include a variety of additional and/or alternative components.

Figure 2:
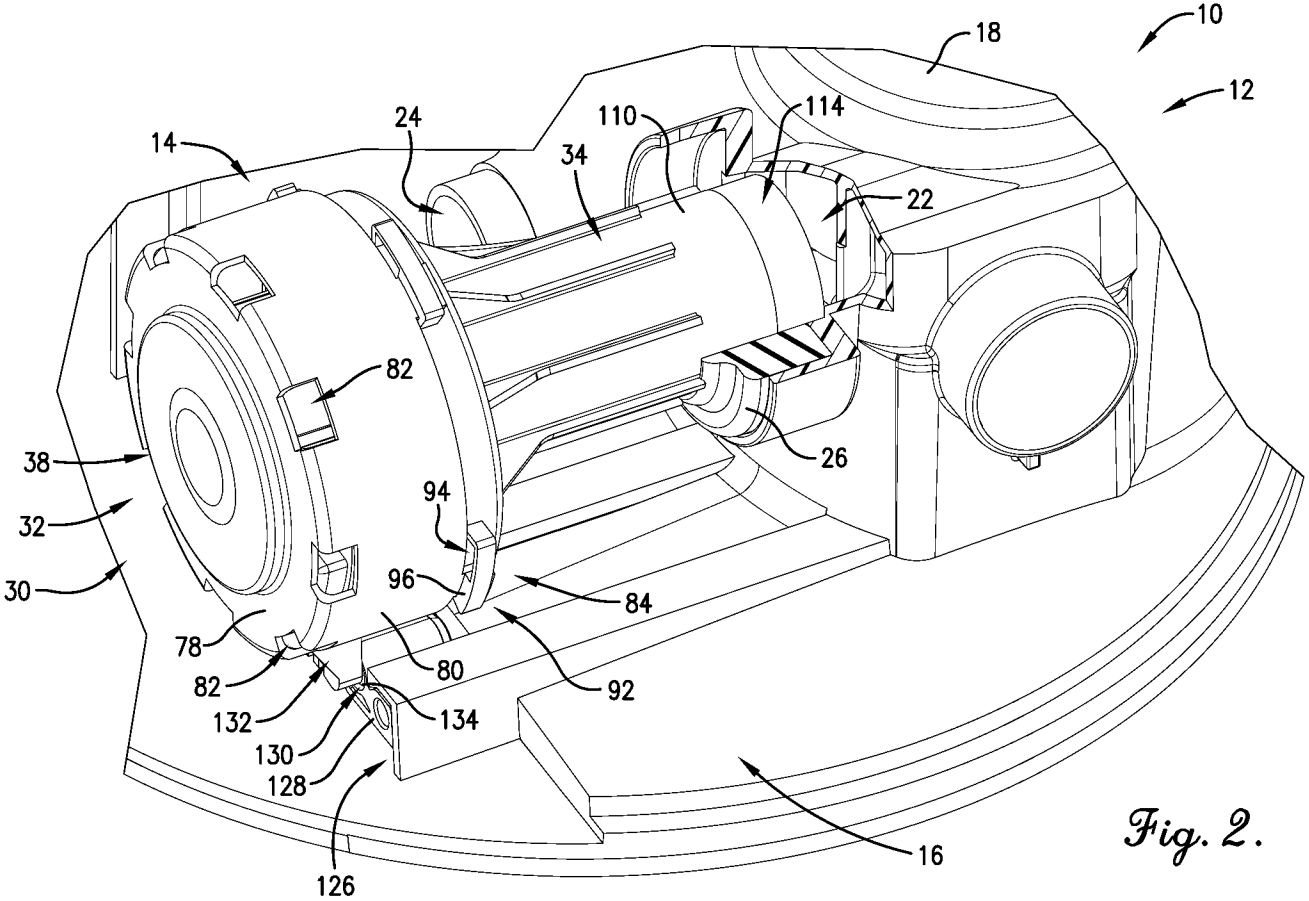
FIG. 2 is an enlarged, fragmented view of the dishwasher portion of FIG. 1, particularly illustrating the pump inlet connection to the sump.
Figure 3:
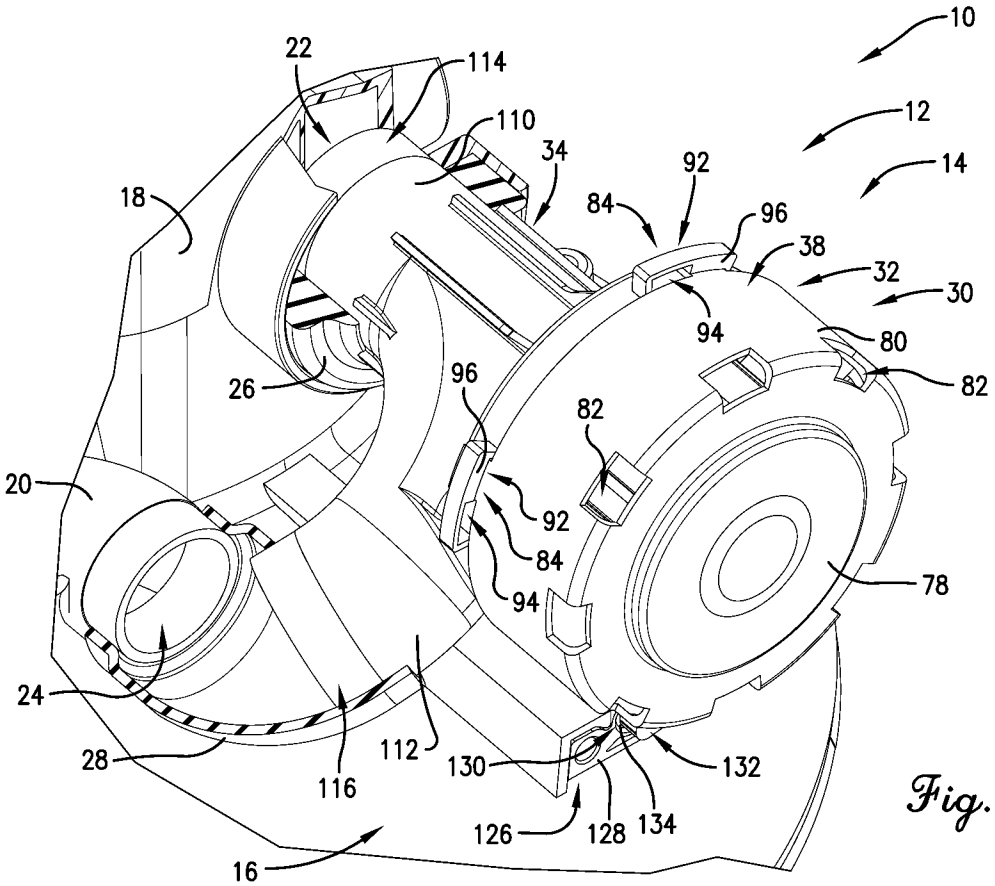
FIG. 3 is an enlarged, fragmented view of the dishwasher portion of FIG. 1, particularly illustrating the pump inlet and outlet connections to the sump.

As best shown in FIGS. 2 and 3, the appliance 10 preferably defines a supplying orifice 22 and a receiving orifice 24. As will be discussed in greater detail below, the supplying orifice 22 is preferably configured to direct fluid to the pump assembly 14, while the receiving orifice 24 is preferably configured to receive fluid from the pump assembly 14.

In a preferred embodiment, the supplying orifice 22 is adjacent the drainage basin 18 and in fluid communication therewith, such that fluid from the drainage basin 18 is supplied to the pump assembly 14 via the supplying orifice 22. Furthermore, the receiving orifice 24 is preferably adjacent the sprayer supply channel 20 such that fluid from the pump assembly 14 is supplied to the sprayer supply channel 20 via the receiving orifice 24.

However, it is permissible for the supplying orifice and the receiving orifice to be alternatively positioned or defined. It is also permissible for some or all of the flow to be diverted from the flow path described above. For instance, some or all of the fluid entering the drain chamber might in some cases be diverted away from the supplying orifice, such that the fluid is not recirculated by the pump assembly 14 and the sprayer arms.

It is also permissible for the flow direction be opposite of that described above, such that what is referred to herein as the supplying orifice actually receives fluid and what is referred to herein as the receiving orifice actually supplies fluid. The flow direction may also be reversible, such that each orifice both supplies and receives fluid as dictated by the flow direction.

In a preferred embodiment, the pump assembly 14 is fluidly coupled to the tub 12 and, more particularly, to the sump 16 via an inlet connector 26 and an outlet connector 28. Preferably, the inlet connector 26 extends at least substantially linearly between the supplying orifice 22 and the pump assembly 14, while the outlet connector 28 extends in a curved manner to form an elbow between the pump assembly 14 and the receiving orifice 24. However, it is permissible for connectors of any shape or size to be used or for only one of the inlet and the outlet to be fluidly coupled to the tub. For instance, the inlet might be coupled to the tub, while the outlet might be coupled to a drainage line configured to direct fluid to a location remote from the appliance.

Preferably, the connectors 26 and 28 comprise a water-resistant material. More preferably, the connectors 26 and 28 comprise a rubber material. However, any one or more of a variety of materials may be used.

Preferably, the connectors 26 and 28 form an at least substantially fluid-tight seal with associated portions of the pump assembly 14 and the sump 16, such that fluid loss associated with connection of the pump assembly 14 to the sump 16 is minimized. However, seal quality may vary.

Preferably, the connectors 26 and 28 are at least substantially flexible to aid in assembly of the appliance 10. However it is permissible for rigid connectors to be used. Furthermore, it is permissible for additional connectors to be provided or for individual ones of the connectors to comprise a plurality of segments.

Figure 4:
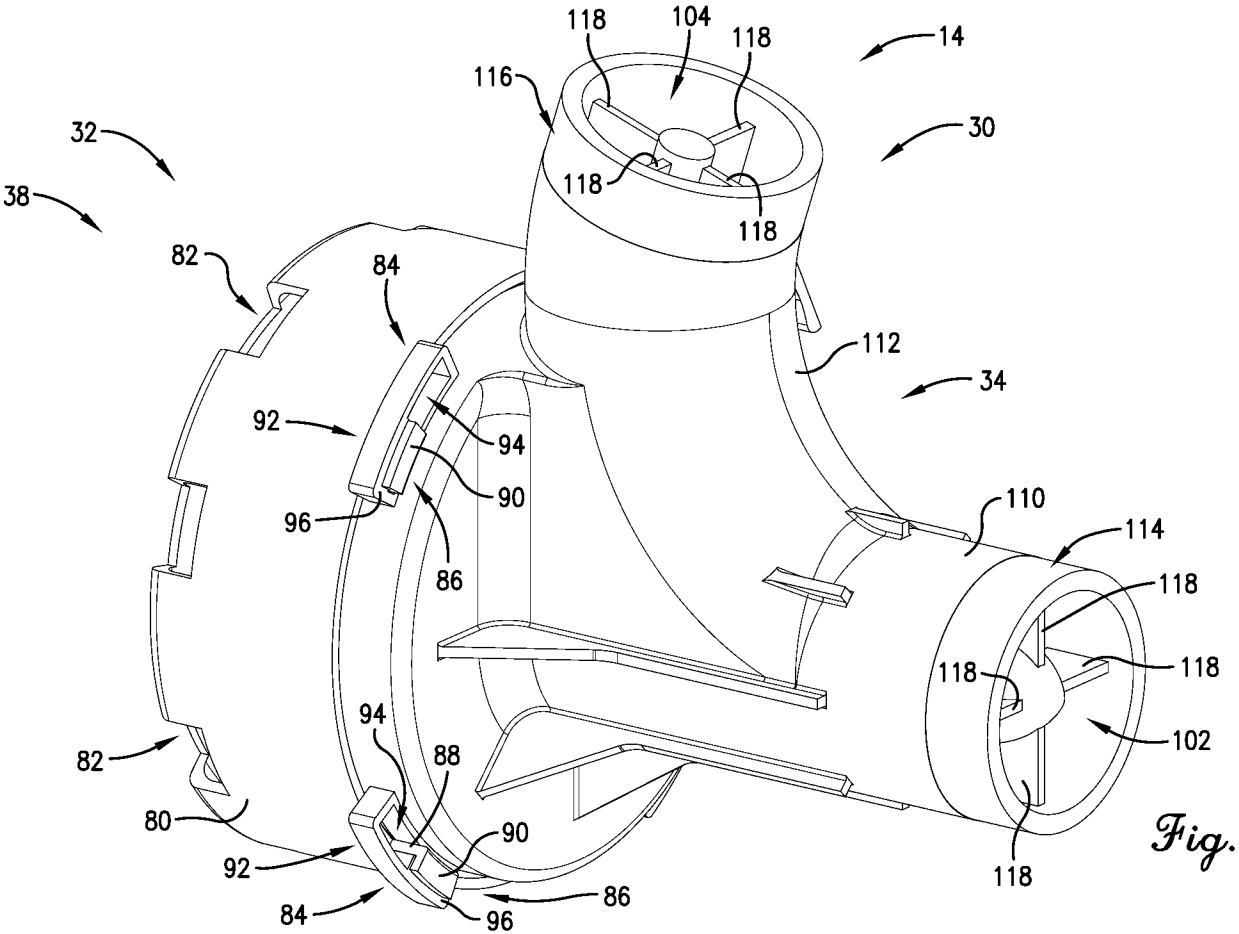
FIG. 4 is an enlarged perspective view of the pump of FIG. 1.
Figure 5:
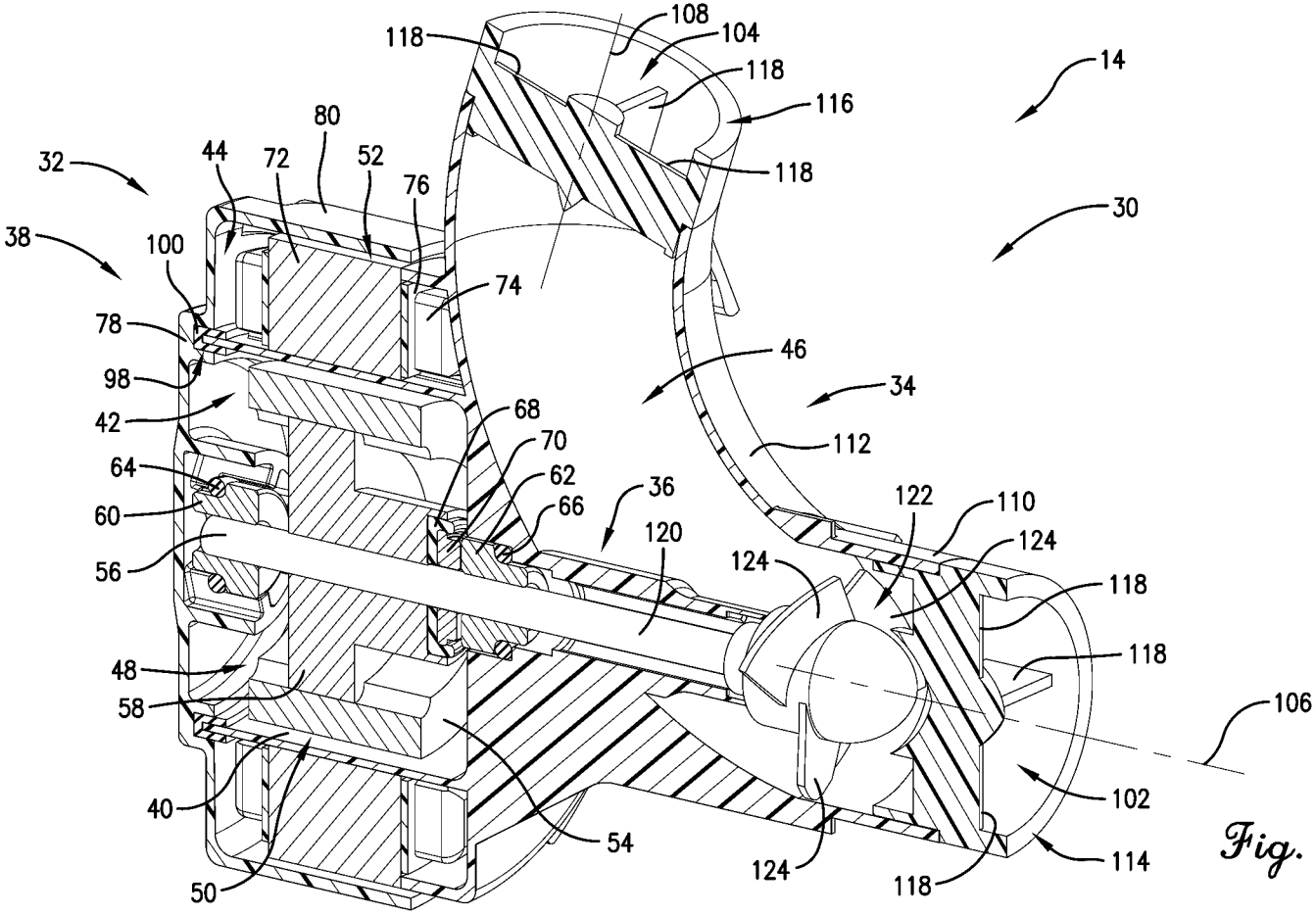
FIG. 5 is a cross-sectional view of the pump of FIG. 5, particularly illustrating the relative positioning of the inlet, the outlet, the impeller, the shaft, and the rotor.

As best shown in FIGS. 4 and 5, the pump assembly 14 preferably includes a housing 30 including a motor portion 32, a flow path portion 34, and a sheath portion 36. As will be discussed in greater detail below, the motor portion 32 preferably includes a cover 38 and a partition 40 that cooperatively define a rotor compartment 42 and a stator compartment 44, while the flow path portion 34 preferably defines a flow path 46.

Preferably, the housing 30 comprises plastic, although any one or more of a variety of materials may be used without departing from the scope of the present invention.

As shown in FIG. 5, the pump assembly 14 preferably includes a motor 48 including a rotor 50 and a stator 52. The rotor 50 is preferably rotatably disposed in the rotor compartment 42, while the stator 52 is preferably disposed in the stator compartment 44 and fixed to the housing 30.

In a preferred embodiment, the motor 48 is a wet rotor motor. More particularly, the rotor compartment 42 is preferably spaced from but fluidly connected to the flow path 46 so as to present a wet rotor design. However, it is permissible according to some aspects of the present invention for the motor to include mechanical face seals or other structures designed to limit or at least substantially restrict the ingress of fluid into the rotor compartment.

In a preferred embodiment, the motor 48 is a three-phase motor. However, according to some aspects of the present invention, the motor may alternatively be a two-phase motor, a single phase motor, or any of a variety of other types of motors known in the art.

It is also preferable that the motor 48 be a brushless permanent magnet (BPM) motor. However, according to some aspects of the present invention, the motor may be any type of motor, including but not limited to a permanent-split capacitor motor, a split phase motor, a synchronous motor, a switched reluctance motor, or a controlled induction motor.

The motor 48 is preferably a variable speed motor, although it is permissible according to some aspects of the present invention for the motor to be a fixed speed motor.

In a preferred embodiment, the motor 48 is configured to run at a specific speed of 5000 or greater. However, it is permissible according to some aspects of the present invention for the motor to be configured to run at a lower specific speed or speeds.

In a preferred embodiment, the motor 48 is an inner rotor motor, although it is permissible within the scope of some aspects of the present invention for an outer rotor motor, a dual rotor motor, or any other configuration of motor known in the art to be used.

In a preferred embodiment, the rotor 50 includes a plurality of magnets 54, shown schematically in FIG. 5. The magnets 54 may be of any type, including but not limited to rare earth magnets.

In a preferred embodiment, the pump assembly 14 further includes a shaft 56 rotatable about a shaft axis. Preferably, the rotor 50 includes a connection element 58 extending between and interconnecting the magnets 54 and the shaft 56 such that the rotor 50 and the shaft 56 are fixed to each other and rotate simultaneously. However, it is permissible according to some aspects of the present invention for the shaft 56 to be disposed relative to the rotor 50 in any manner by which rotation of the rotor drives rotation of the shaft. A gear and/or pulley based transmission system might be provided, for instance, to allow the shaft to be mounted remotely from the rotor.

Preferably, the shaft axis and the rotor axis are at least substantially parallel or, more preferably, at least substantially aligned. However, it is permissible according to some aspects of the present invention for such axes to be non-parallel and/or non-aligned.

In a preferred embodiment, the rotor 50 and the shaft 56 are rotatably supported in the motor portion 32 of the housing 30 by a pair of bearings 60 and 62. The bearings 60 and 62 are secured to the housing 30 by respective rings 64 and 66. In addition to supporting the bearings 60 and 62, the rings 64 and 66 are preferably elastomeric and thereby configured to absorb tolerances and aid in bearing installation. As noted previously, however, the motor 48 is preferably a wet-rotor motor, with the rings 64 and 66 not being configured to form a fluid-tight seal.

Although the above-described rotor and shaft support configuration is preferred, it is permissible for any rotational support means known in the art to be used to rotatably support the rotor and shaft.

Preferably, a retainer 68 and a thrust washer 70 are positioned between the connection element 58 and the bearing 62 to absorb axial loads exerted therebetween.

The stator 52 preferably includes a core 72 and a plurality of coils 74 (shown schematically) wound about the core. The core 72 is preferably a laminated core, although non-laminated configurations are permissible, as well. The core 72 preferably extends continuously, although it may alternatively include a plurality of segments. Furthermore, although arcuate extension is preferred, such that the core 72 takes an annular or toroidal form, it is permissible for the core to define an alternative shape. Among other things, for instance, the core could define square inner and/or outer perimeters, or the core could define a circular inner perimeter and a octagonal outer perimeter.

The coils 74 preferably comprise wires comprising one or more electrically conductive materials, including but not limited to aluminum or copper. The wires may be coated or uncoated without departing from the scope of the present invention.

As illustrated schematically in FIG. 5, the stator 52 preferably includes an electrically insulative layer 76 between the core 72 and the coils 74. The insulative layer 76 may suitably comprise tabs, a powder coating, or any other insulation means known in the art. Furthermore, it is permissible for the stator to be non-insulated.

Additional insulation (not shown) such as stamped Mylar® may be provided as necessary between the coils of the stator and the housing, with provision of such insulation enabling the stator to be positioned closer to the housing and/or for the size of the stator compartment to be decreased. However, it is permissible for such additional insulation to be omitted.

As noted previously, the motor portion 32 preferably includes a cover 38 and a partition 40. The cover 38 preferably includes a radially-extending, at least substantially circular end portion 78 and a side portion 80 that extends axially from the end portion 78 to at least at least substantially circumscribe the stator 52. Preferably, a plurality of ventilation slots 82 are formed at the intersection of the end portion 78 and the side portion 80 to aid in cooling of the motor 48. However, it is within the scope of the present invention for alternative motor portion configurations to be used. Among other things, for instance, the side portion might be circumferentially discontinuous, or the end portion and/or the side portion might be non-circular or non-cylindrical, respectively. Alternatively located or shaped ventilation slots might be provided, or the motor portion might be entirely devoid of ventilation slots.

In a preferred embodiment, the cover 38 is positioned adjacent the flow path portion 34 and is removably retained thereon. More particularly, the cover 38 is preferably attached to the flow path portion 34 by a lock mechanism 84 that is operated by relative twisting between the components. As best shown in FIG. 4, the lock mechanism 84 preferably includes a plurality of evenly arcuately spaced apart hooks 86. Each of the hooks 86 preferably includes a base 88 extending axially from the side portion 80 of the cover 38 and a corresponding catch 90 extending radially outwardly from the base 88. A corresponding plurality of receivers 92, each of which includes an opening 94 and a shelf 96, is preferably formed on or adjacent the flow path portion 34. For assembly, the cover 38 is preferably moved axially toward the flow path portion 34 (or vice versa) such that the hooks 86 extend through the openings 94. Twisting or rotation of the cover 38 such that the catches 90 engage and rest upon corresponding ones of the shelves 96 then secures the cover 38 and the flow path portion 34 to each other.

Although the above-described lock mechanism is preferred, it is permissible for any attachment means, including but not limited to alternatively configured lock mechanisms, adhesives, screws, nuts and bolts, and/or snap-fit elements to be used.

In a preferred embodiment, the partition 40 extends axially between the rotor 50 and the stator 52 to at least substantially circumscribe the rotor 50. In a preferred embodiment, the partition 40 is circumferentially continuous, although non-continuous configurations are permissible.

The partition 40 is preferably positioned relative to the side portion 80 of the cover 38 such that the core 72 of the stator 52 abuts both the partition 40 and the side portion 80. However, alternative positioning is possible within the scope of the present invention.

In a preferred embodiment, a groove 98 is formed in the end portion 78 of the cover 38. Preferably, a U-shaped gasket 100 is inserted in the groove 98. The partition 40 is preferably integrally formed with and projects outwardly from the flow path portion 34 of the housing 30 toward and into the gasket 100 in the groove 98. Preferably, the gasket 100 serves to form an at least substantially fluid-tight seal between the cover 38 and the partition 40, such that fluid ingress into the stator compartment 44 is at least substantially prohibited.

However, the partition could be formed and/or supported in an alternative manner. Among other things, for instance, the partition might be non-integral with the flow path portion and instead affixed thereto by any means known in the art. Furthermore, the partition could alternatively project from the end portion of the motor housing, with a receiving groove and gasket being associated with the flow path portion, or the groove and/or gasket might be omitted in favor of a supporting ledge or other structure configured to provide sufficient structural support.

The flow path portion 34 of the housing 30 is preferably integrally formed and defines an inlet 102 and an outlet 104. The flow path 46 preferably extends between and interconnects the inlet 102 and the outlet 104. The flow path 46 preferably extends along an inlet axis 106 adjacent the inlet 102 and along an outlet axis 108 adjacent the outlet 104.

In a preferred embodiment, the flow path portion 34 includes a linear portion 110 extending from the inlet 102 and a non-linear transition portion 112 extending between and interconnecting the linear portion 110 and the outlet 104. However, it is permissible for the flow path portion to include more portions or only one portion.

Preferably, the flow path portion 34 defines a curve extending such that at least part of the flow path 46 extends in a direction that is oriented at an angle relative to the inlet axis 106. In a preferred embodiment, the transition portion 112 defines the curve. Most preferably, the curved portion of the flow path terminates at the outlet 104, with the outlet axis 108 and the inlet axis 106 defining an angle therebetween.

Preferably, the curve extends such that at least part of the flow path 46 extends in a direction that is approximately ninety (90) degrees relative to the inlet axis 106. Most preferably, the curve in the flow path 46 extends such that the outlet axis 108 is at least substantially orthogonal to the inlet axis 106.

However, it is within the scope of some aspects of the present invention for any of a variety of acute or obtuse angles to be defined relative to the inlet axis. More particularly, although the flow path portion 34 most preferably defines a flow path turn of approximately ninety (90) degrees, the angle of the flow path 46 may suitably be in a range from about twenty (20) degrees to one hundred sixty (160) degrees relative to the inlet axis.

It is also noted that the total angle defined in the flow path 46 is approximately ninety (90) degrees in the illustrated embodiment. It is important that some angle in the range be defined, but other angles may be defined elsewhere in the flow path. For instance, according to some aspects of the present invention, multiple turns may be defined in the flow path. Again, however, it is most preferred that the flow path 46 present a total angular relationship between the inlet and outlet axes 106 and 108, respectively, of ninety (90) degrees.

It is also permissible for the transition portion to include a plurality of curved, straight, and/or mixed-design segments that cooperatively define at least a part of the above-described curve.

Preferably, flow path portion 34 has an at least substantially constant circular cross-section and wall thickness such that the flow path 46 has an at least substantially constant circular cross-section. However, it is permissible to incorporate a variety of modifications into the flow path portion and, in turn, vary the flow path shape and size. For instance, the flow path might include expanded, constricted, and/or alternatively shaped regions due to variations in the outer dimensions and shape of the flow path portion and/or the wall thickness of the flow path portion.

In a preferred embodiment, the flow path portion 34 includes stationary vane inserts 114 and 116 adjacent the inlet 102 and the outlet 104, respectively. Each of the inserts 114 and 116 includes a plurality of vanes 118 configured to direct the flow of fluid as desired. Although straight and evenly spaced apart vanes 118 are shown, it is permissible for any vane shape or configuration to be utilized. It is also permissible for only one insert to be provided or for the inserts to be excluded entirely. Additional sets of vanes might be provided, and/or the vanes might be positioned elsewhere in the flow path. Still further, vanes might instead be integrally formed with the flow part portion or associated therewith in any other manner known in the art.

Preferably, a portion 120 of the shaft 56 extends through the flow path portion 34 of the housing 30 into the flow path 46. Most particularly, the shaft portion 120 preferably extends through the transition portion 112 of the flow path portion 34 into the flow path 46. However, it is permissible according to some aspects of the present invention for the shaft portion to extend into the flow path via an alternative route.

As noted above, the housing 30 preferably includes a sheath portion 36. The sheath portion 36 preferably receives at least a substantial part of the shaft portion 120 positioned in the flow path 46. In a preferred embodiment, the sheath portion 36 is circumferentially continuous so as to at least substantially circumscribe the shaft portion 120, although non-continuous configurations are permissible.

Preferably, the sheath portion 36 projects into the flow path 46 from the flow path portion 34 of the housing 30. Furthermore, the sheath portion 36 is preferably integrally formed with the flow path portion 34 of the housing 30. However, the sheath portion could alternatively be non-integral with the flow path portion and instead affixed thereto by any means known in the art.

In a preferred embodiment, the pump assembly 14 includes an impeller 122 rotatable about an impeller axis. The impeller 122 preferably includes a plurality of blades 124 extending at least substantially radially from the impeller axis and configured to propel a fluid at least substantially axially thereby. The blades 124 may be pitched or shaped as required to achieve the desired flow characteristics. Preferably, the spacing of the blades 124 is such that particulate may pass between the blades 124 without jamming the impeller 122. However, blade spacing may be varied without departing from the scope of the present invention.

Preferably, the impeller 122 is fixed to the shaft 56 to rotate therewith, with the shaft axis of rotation and the impeller axis of rotation being at least substantially aligned. However, it is permissible according to some aspects of the present invention for the axes to be non-aligned so as to be at least substantially parallel or to form an angle therebetween. It is also permissible according to some aspects of the present invention for the impeller to be mounted or disposed relative to the shaft such that rotation of the shaft indirectly drives rotation of the impeller. For instance, a gear and/or pulley-based system might be provided to interconnect the shaft and the impeller.

In a preferred embodiment, the impeller 122 is positioned in the flow path 46 adjacent the inlet 102 and, more particularly, at least in part in the linear portion 110 of the flow path portion 34. Thus, flow through the impeller 122 is at least substantially axial.

Preferably, the impeller axis and the inlet axis 106 are at least substantially parallel or at least substantially aligned such that the outlet axis 108 and the impeller axis form an angle therebetween. Most preferably, the outlet axis 108 is at least substantially orthogonal to the impeller axis and the inlet axis 106, with the impeller axis and the inlet axis 106 being at least substantially aligned.

As can be inferred from the above, most preferably, the rotor axis, the shaft axis, the impeller axis, and the inlet axis 106 are at least substantially aligned, with the outlet axis 108 being at least substantially orthogonal thereto.

As shown in FIGS. 1-3, the sump 16 preferably defines a pump assembly support slot 126, while the appliance 10 preferably includes a support insert 128 configured to be received in the slot 126. The support insert 128 preferably defines an opening 130. Preferably, the support insert 128 comprises rubber, although any one or more of a variety of materials may be used without departing from the scope of the present invention. The housing 30 preferably includes a support hook 132 including a projection 134 configured to be received in the opening 130. The pump assembly 14 is thus supported in the appliance 10 at least in part by the insert 128, which rests in the slot 126, and the support hook 132, which is at least in part received in the opening 130 of the insert 128. Preferably, the support hook 132 is integrally formed with motor portion 32 of the housing 30 and, more particularly, with the side portion 80 of the cover 38 of the motor portion 32. However, the hook might alternatively be non-integral with the housing and/or be positioned elsewhere. It is also permissible for additional means or entirely different means of supporting the pump assembly to be provided.

In operation of a preferred embodiment of the present invention, fluid flows from the tub 12 and, more particularly, from the drainage basin 18 of the sump 16, through the supplying orifice 22, and to the inlet 102 of the flow path portion 34 of the housing 30. The fluid preferably flows along the inlet axis 106 at the inlet 102 and through the stationary vane insert 114 into the portion of the flow path 46 defined by the linear portion 110 of the flow path portion 34. The motor 48 drives rotation of the shaft 56 and the impeller 122, such that the impeller 122 propels fluid in the linear portion 110 at least substantially axially therethrough. The fluid travels in the flow path 46 along the curve defined by the transition portion 112, then past the stationary vane insert 116. The fluid then flows out of the outlet 104 and to the receiving orifice 24 along the outlet axis 108. Fluid passes through the receiving orifice 24, into the sprayer supply channel 20, and to the sprayer arms. After ejection from the sprayer arms, the fluid is again retained in the tub 12, and the cycle repeats.

The pump assembly 14 described above presents numerous advantages. For instance, the pump assembly 14 is operable at high speeds and with high efficiency at such speeds. Such high speed and high efficiency capabilities allow use of a smaller pump assembly 14 than would otherwise be required to achieve the desired performance in the appliance 10. Use of a smaller pump assembly 14 may in turn lead both to cost savings and to reduced noise.

These advantages, in combination with geometric advantages provided by the small envelope required for the preferred design, may also enable use of the pump in assembly 14 in applications in which a different type of pump assembly is typically used. For instance, many conventional household appliances utilize radial-flow centrifugal pumps driven by fixed speed motors having two pole motor speeds between 3,000 rpm and 3,600 rpm. Variable speed motors with slightly higher maximum speeds are also known to be used in appliances and are also often used to drive radial-flow centrifugal pumps. Typically, liquid orifice positions and surrounding structures of the appliance are designed to accommodate the selected type of pump and motor. At least in part due to restrictions such as those described above, if replacement of an existing pump assembly is necessary or desired, such replacement is typically done using a pump assembly of the same general type. For instance, in a dishwasher having a first radial-flow centrifugal pump assembly, replacement of the first pump assembly would typically be with a second radial-flow centrifugal pump assembly. However, the performance and noise characteristics of the pump assembly 14, in coordination with its size and configuration, make it well suited for use as a pump assembly in a conventional appliance such as that described above. More particularly, for certain conventional appliances, the pump assembly 14 is configured to fit in the envelope provided for the original radial-flow centrifugal pump assembly, to connect easily to the sump of the conventional appliance, and to enable equal or better appliance performance than was achieved using the radial-flow centrifugal pump assembly.

In an alternative application, the pump assembly 14 is well suited for use as an original pump in an appliance originally designed for use with a radial-flow centrifugal pump assembly. That is, an original equipment manufacturer could transition from creating appliances having radial-flow centrifugal pumps assembles to creating appliances having pumps assemblies such as pump assembly 14 without significant redesign.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention set forth in the following claims.

What is claimed is:

1. A household appliance comprising:

a tub configured to contain a liquid; and a pump assembly for effecting liquid flow within the tub, said pump assembly including:

a housing including a motor portion and a flow path portion, said flow path portion being integrally formed and defining an inlet, an outlet, and a flow path extending between and interconnecting the inlet and the outlet, at least one of said inlet and said outlet being fluidly coupled to the tub, said flow path extending along an inlet axis of the inlet and along an outlet axis of the outlet, said flow path portion defining a turn, such that at least part of the flow path extends in a direction that is oriented at an angle relative to the inlet axis, a motor including a rotor and a stator, with the stator being fixed relative to the motor portion, at least part of said motor portion being integrally formed with the flow path portion and defining a rotor compartment in which the rotor is rotatably disposed, said rotor compartment and said rotor being spaced from the flow path, an impeller rotatable about an impeller axis, said impeller including a plurality of blades extending at least substantially radially from the impeller axis and configured to propel a fluid along the flow path, wherein said impeller is positioned in the flow path closer to the inlet than the outlet, with the impeller axis and the inlet axis being at least substantially parallel or at least substantially aligned, and a rotatable shaft extending between and operably interconnecting the rotor and the impeller to transmit rotation of the rotor to the impeller, said rotor compartment being fluidly connected to the fluid path so as to present a wet rotor design, said motor portion including a cover and a partition,
said cover at least substantially circumscribing the stator,
said partition extending between the rotor and the stator to at least substantially circumscribe the rotor,
said cover being removably retained on the flow path portion,
said partition being integrally formed with the flow path portion, such that said at least part of the motor portion includes the partition.

2. The appliance as claimed in claim 1,
said shaft being rotatable about a shaft axis.

3. The appliance as claimed in claim 2,
said shaft axis and said impeller axis being at least substantially parallel or at least substantially aligned, such that the shaft axis and the outlet axis define an angle therebetween.

4. The appliance as claimed in claim 2,
said impeller being fixed to the shaft to rotate therewith,
said shaft being fixed to the rotor to rotate therewith.

5. The appliance as claimed in claim 2,
a portion of said shaft extending through the flow path portion of the housing into the flow path.

6. The appliance as claimed in claim 5,
said housing further including a sheath portion,
said sheath portion receiving at least a substantial part of the shaft portion positioned in the flow path.

7. The appliance as claimed in claim 1,
said outlet axis being at least substantially orthogonal to the inlet axis and the impeller axis.

8. The appliance as claimed in claim 1,
said flow path portion including a linear portion extending from the inlet,
said impeller being positioned at least in part in the linear portion.

9. The appliance as claimed in claim 8,
said flow path portion including a non-linear transition portion extending between and interconnecting the linear portion and the outlet,
said non-linear transition portion defining a curve extending such that the outlet axis is at least substantially orthogonal to the impeller axis and the inlet axis.

10. The appliance as claimed in claim 1,
said motor being a three-phase, brushless permanent magnet motor.

11. The appliance as claimed in claim 1,
said outlet defining the at least part of the flow path, such that the inlet axis and the outlet axis define an angle therebetween.

12. An appliance pump assembly for effecting liquid flow within a tub of the appliance, said pump assembly comprising:
a housing including a motor portion and a flow path portion,
said flow path portion being integrally formed and defining an inlet, an outlet, and a flow path extending between and interconnecting the inlet and the outlet,
at least one of said inlet and said outlet being fluidly coupled to the tub,
said flow path extending along an inlet axis of the inlet and along an outlet axis of the outlet,
said flow path portion defining a turn, such that at least part of the flow path extends in a direction that is oriented at an angle relative to the inlet axis,
a motor including a rotor and a stator, with the stator being fixed relative to the motor portion,
at least part of said motor portion being integrally formed with the flow path portion and defining a rotor compartment in which the rotor is rotatably disposed,
said rotor compartment and said rotor being spaced from the flow path,
said rotor compartment being fluidly connected to the fluid path so as to present a wet rotor design;
an impeller rotatable about an impeller axis,
said impeller including a plurality of blades extending at least substantially radially from the impeller axis and configured to propel a fluid along the flow path,
wherein said impeller is positioned in the flow path closer to the inlet than the outlet, with the impeller axis and the inlet axis being at least substantially parallel or at least substantially aligned; and
a rotatable shaft extending between and operably interconnecting the rotor and the impeller to transmit rotation of the rotor to the impeller,
said motor portion including a cover and a partition,
said cover at least substantially circumscribing the stator,
said partition extending between the rotor and the stator to at least substantially circumscribe the rotor,
said cover being removably retained on the flow path portion,
said partition being integrally formed with the flow path portion.

13. The appliance pump assembly as claimed in claim 12,
said shaft being rotatable about a shaft axis.

14. The appliance pump assembly as claimed in claim 13,
said shaft axis and said impeller axis being at least substantially parallel or at least substantially aligned, such that the shaft axis and the outlet axis define an angle therebetween.

15. The appliance pump assembly as claimed in claim 13,
said impeller being fixed to the shaft to rotate therewith,
said shaft being fixed to the rotor to rotate therewith.

16. The appliance pump assembly as claimed in claim 13,
a portion of said shaft extending through the flow path portion of the housing into the flow path.

17. The appliance pump assembly as claimed in claim 16,
said housing further including sheath portion,
said sheath portion receiving at least a substantial part of the shaft portion positioned in the flow path.

18. The appliance pump assembly as claimed in claim 12,
said outlet axis being at least substantially orthogonal to the inlet axis and the impeller axis.

19. The appliance pump assembly as claimed in claim 12,
said flow path portion including a linear portion extending from the inlet,
said impeller being positioned at least in part in the linear portion.

20. The appliance pump assembly as claimed in claim 19,
said flow path portion including a non-linear transition portion extending between and interconnecting the linear portion and the outlet,
said non-linear transition portion defining a curve extending such that the outlet axis is at least substantially orthogonal to the impeller axis and the inlet axis.

21. The appliance pump assembly as claimed in claim 12,
said motor being a three-phase, brushless permanent magnet motor.

22. The appliance pump assembly as claimed in claim 12,
said outlet defining the at least part of the flow path, such that the inlet axis and the outlet axis define an angle therebetween.

* * * * *